US009061432B2

(12) United States Patent
Reifenhaeuser

(10) Patent No.: US 9,061,432 B2
(45) Date of Patent: Jun. 23, 2015

(54) METHOD AND DEVICE FOR CUTTING A FOOD STRAND INTO SLICES

(75) Inventor: Uwe Reifenhaeuser, Flammersfeld (DE)

(73) Assignee: Uwe Reifenhaeuser, Flammersfeld (DE)

( * ) Notice: Subject to any disclaimer, the term of this patent is extended or adjusted under 35 U.S.C. 154(b) by 288 days.

(21) Appl. No.: 13/526,619

(22) Filed: Jun. 19, 2012

(65) Prior Publication Data

US 2013/0160620 A1 Jun. 27, 2013

(30) Foreign Application Priority Data

Jun. 20, 2011 (DE) ..... 10 2011 051 210

(51) Int. Cl.
*B26D 7/06* (2006.01)
*B26D 7/02* (2006.01)
*B26D 7/01* (2006.01)

(52) U.S. Cl.
CPC ..... *B26D 7/02* (2013.01); *B26D 7/0616* (2013.01); *Y10T 83/6563* (2015.04); *Y10T 83/04* (2015.04); *Y10T 83/654* (2015.04); *B26D 7/01* (2013.01); *B26D 7/0608* (2013.01); *B26D 7/0641* (2013.01); *B26D 7/0683* (2013.01); *B26D 2007/013* (2013.01); *B26D 2210/02* (2013.01)

(58) Field of Classification Search
USPC ..... 83/932, 13, 29, 56, 703, 409, 409.1, 83/412, 418
See application file for complete search history.

(56) References Cited

U.S. PATENT DOCUMENTS

2006/0196328 A1* 9/2006 Pryor et al. ..... 83/13
2009/0188363 A1* 7/2009 Lindee et al. ..... 83/435.16
2011/0099948 A1* 5/2011 Drebing et al. ..... 53/435

FOREIGN PATENT DOCUMENTS

DE 195 18 583 A1 11/1996
DE 102007063112 A * 7/2009
EP 2 239 108 A2 10/2010

* cited by examiner

*Primary Examiner* — Stephen Choi
(74) *Attorney, Agent, or Firm* — Von Rohrscheidt Patents

(57) ABSTRACT

The invention relates to a method for cutting a food strand into slices including the steps inserting the food strand in a conveying device, conveying the food strand into a transfer position in a feed device, transferring the food strand through the feed device into a feed position where the food strand is more inclined relative to horizontal than in the transfer position, gripping the food strand at a rear end, feeding the food strand towards a cutting device, cutting the food strand into slices through the cutting device, and fixating the food strand at least during transfer from the transfer position into the feed position at least at one of its free longitudinal sides through at least one fixation element providing a form locking and/or friction locking engagement with the food strand. The invention also relates to a device for performing the method.

8 Claims, 12 Drawing Sheets

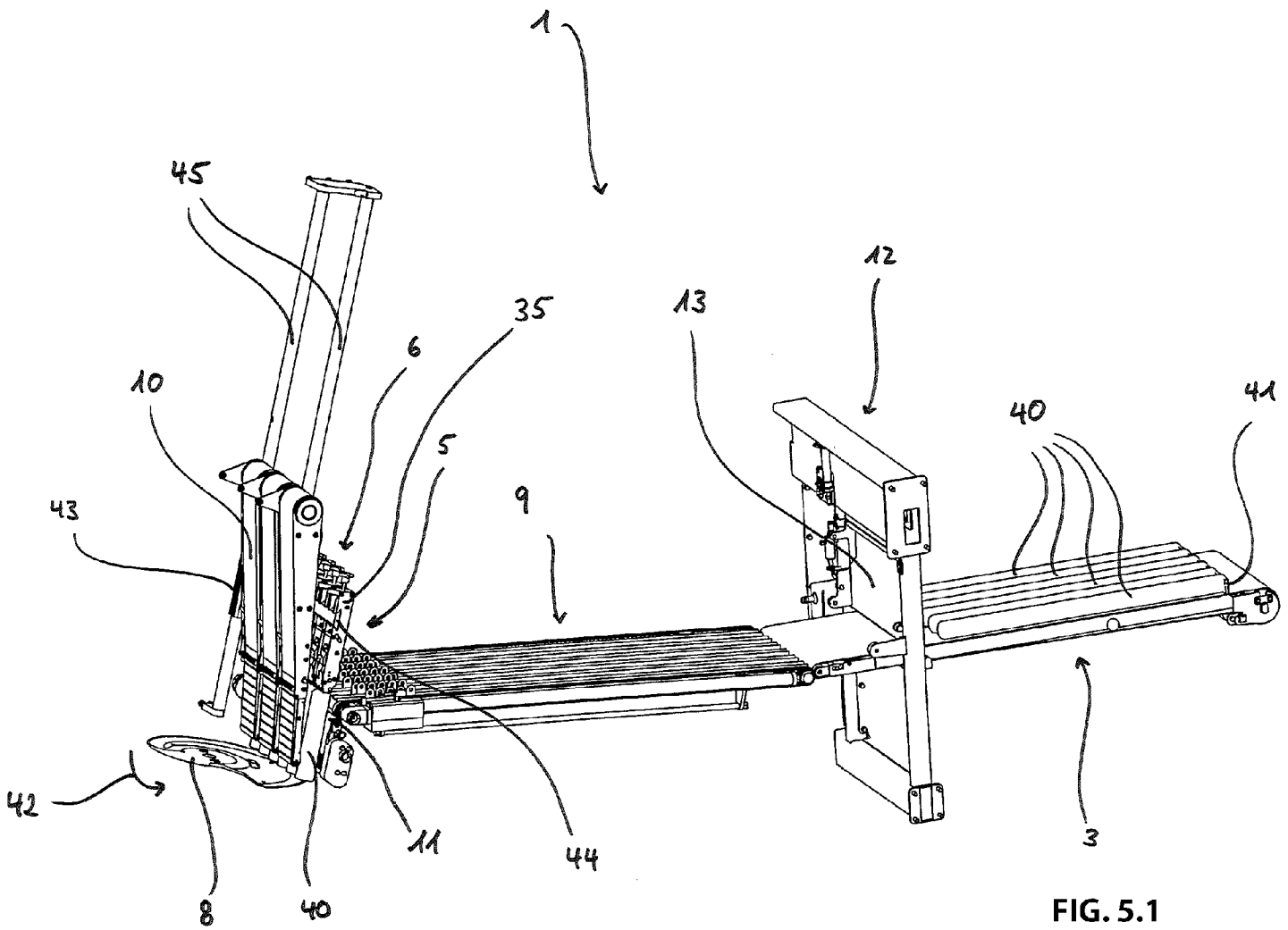
FIG. 5.1

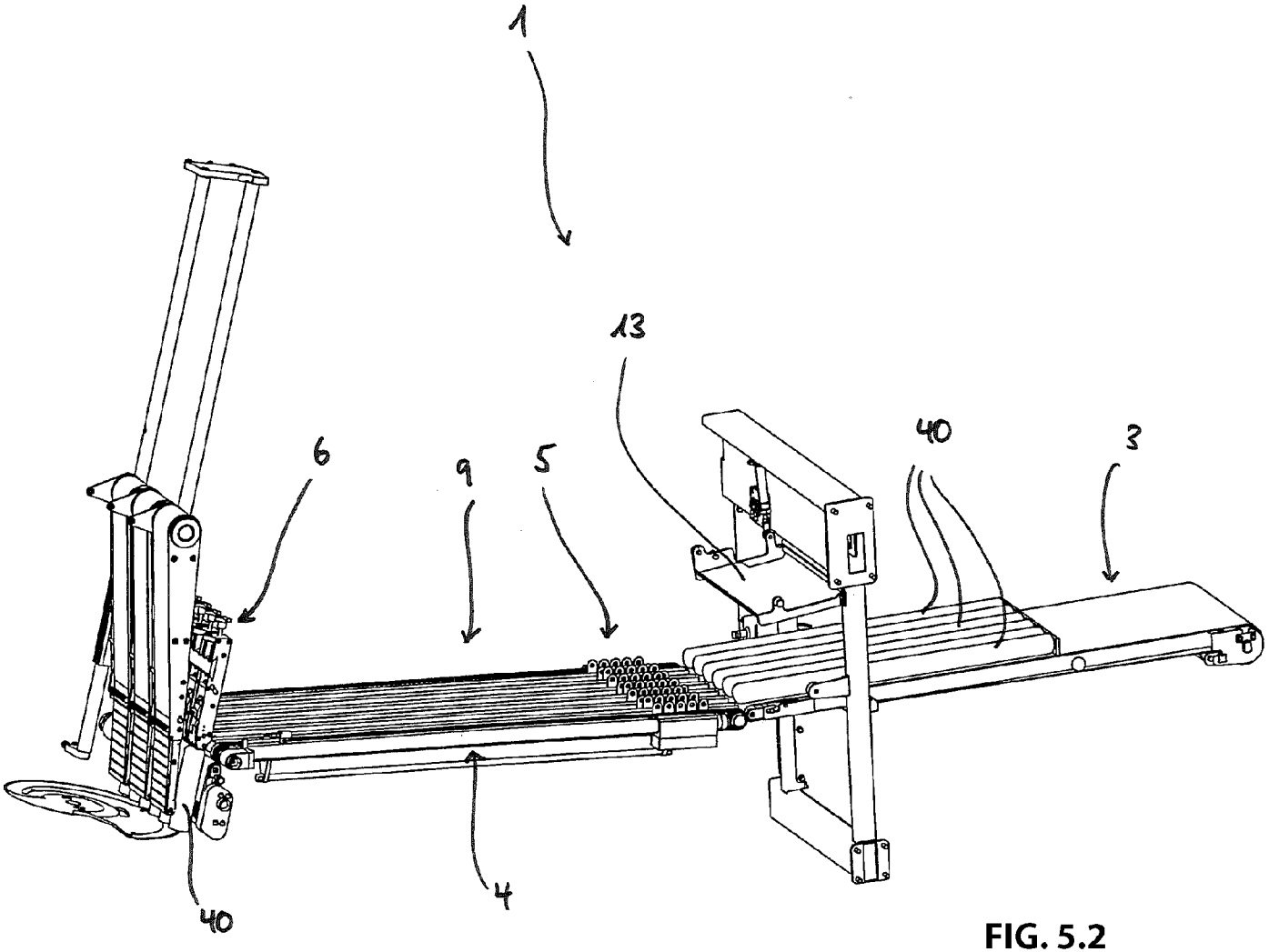
FIG. 5.2

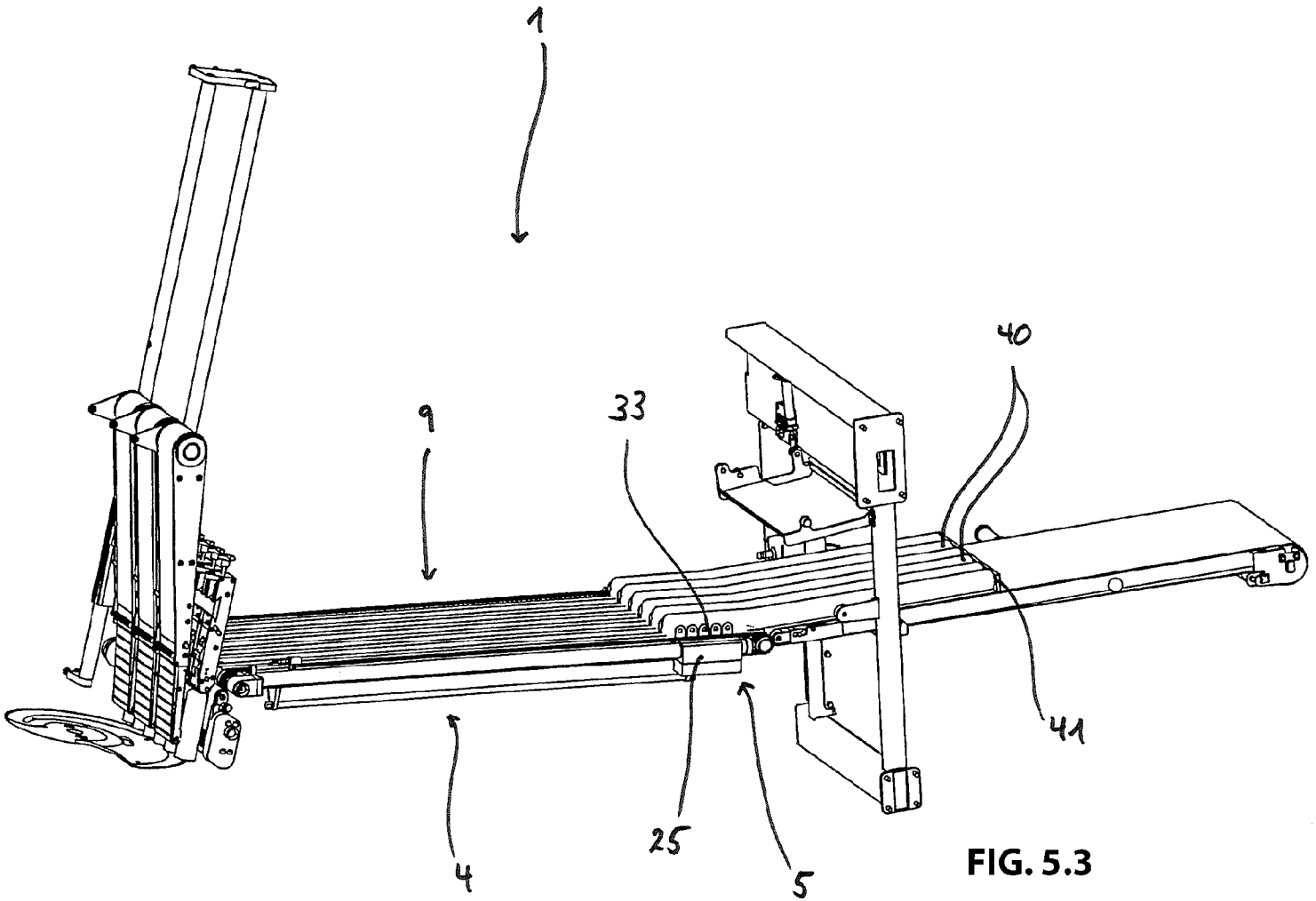
FIG. 5.3

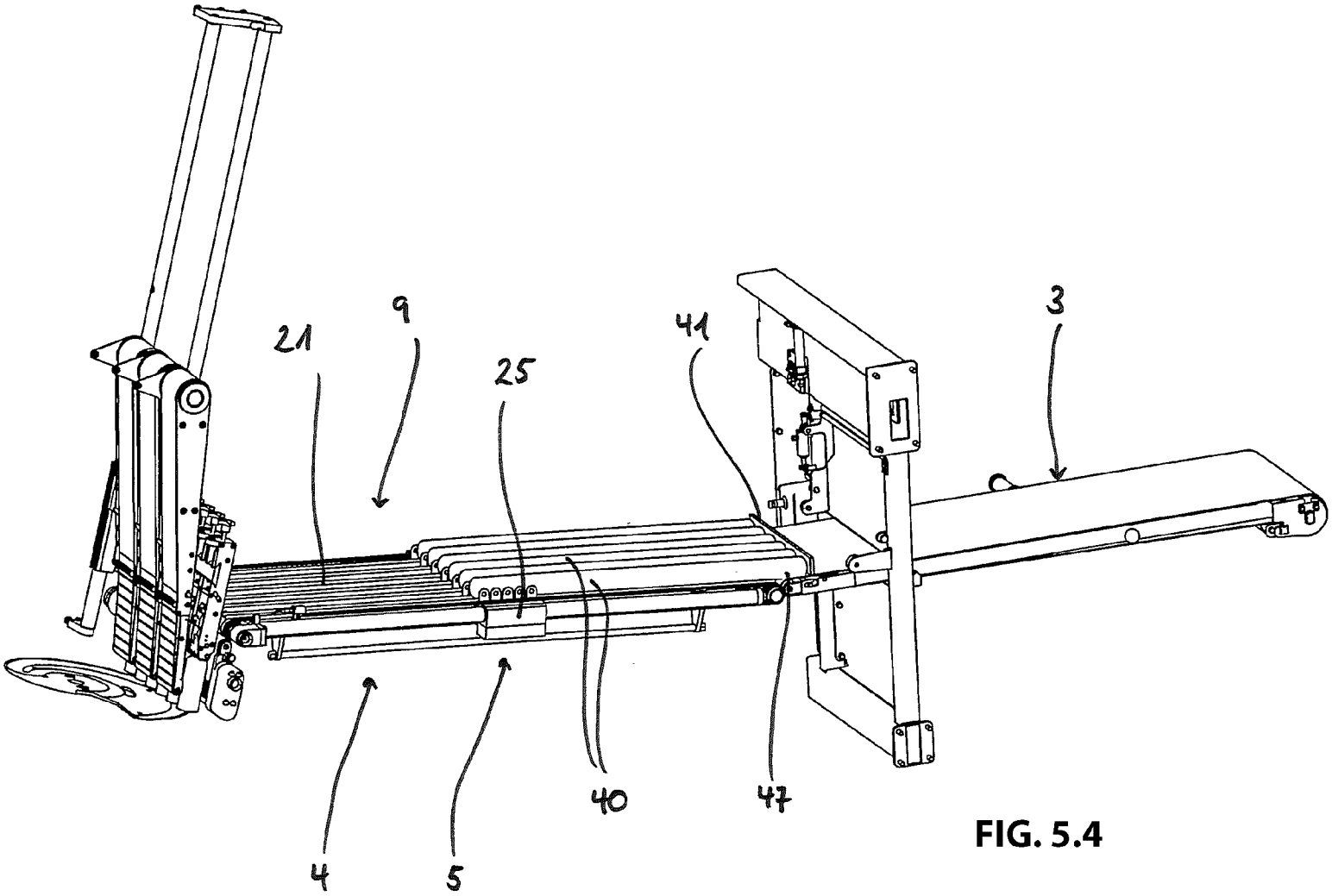
FIG. 5.4

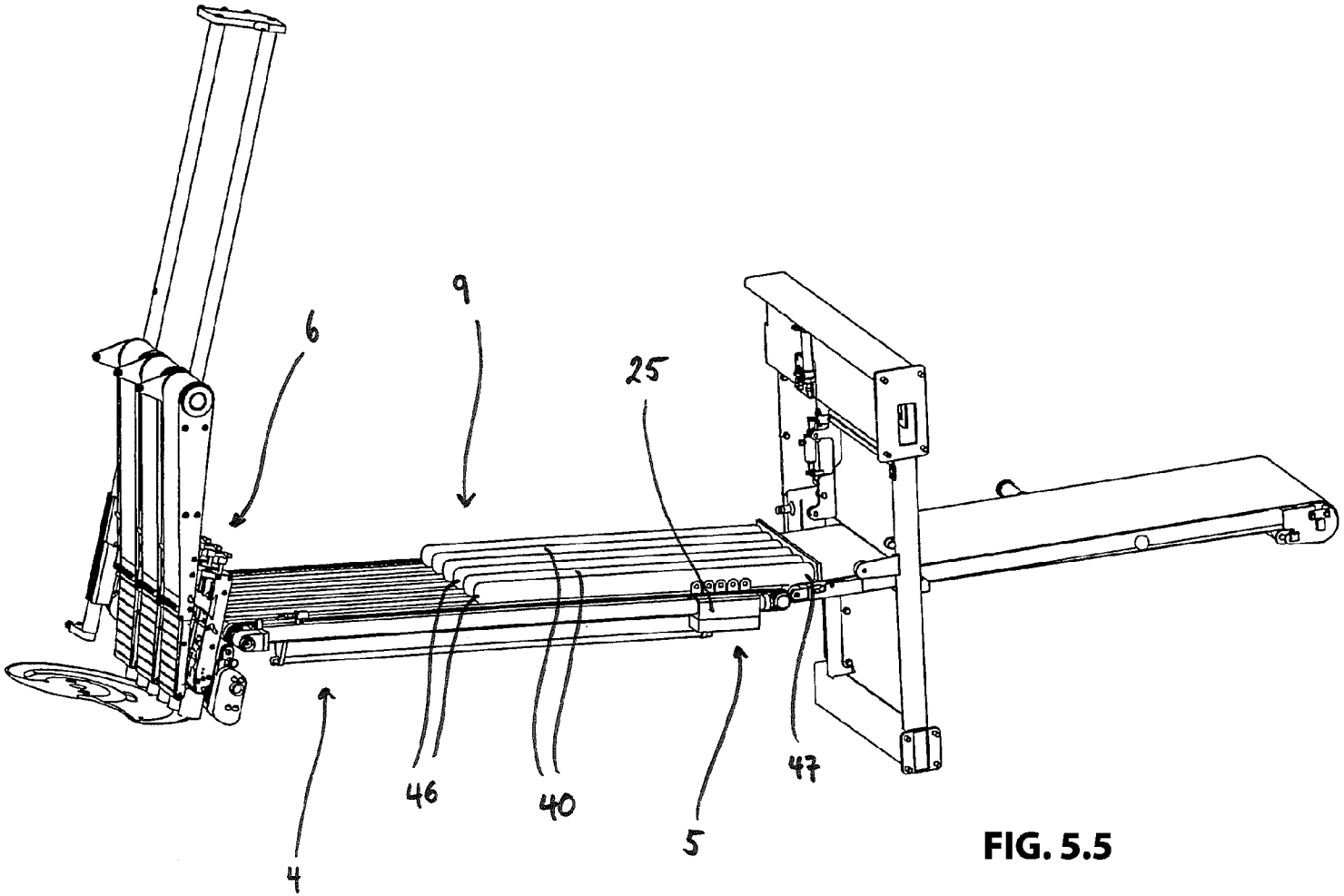
FIG. 5.5

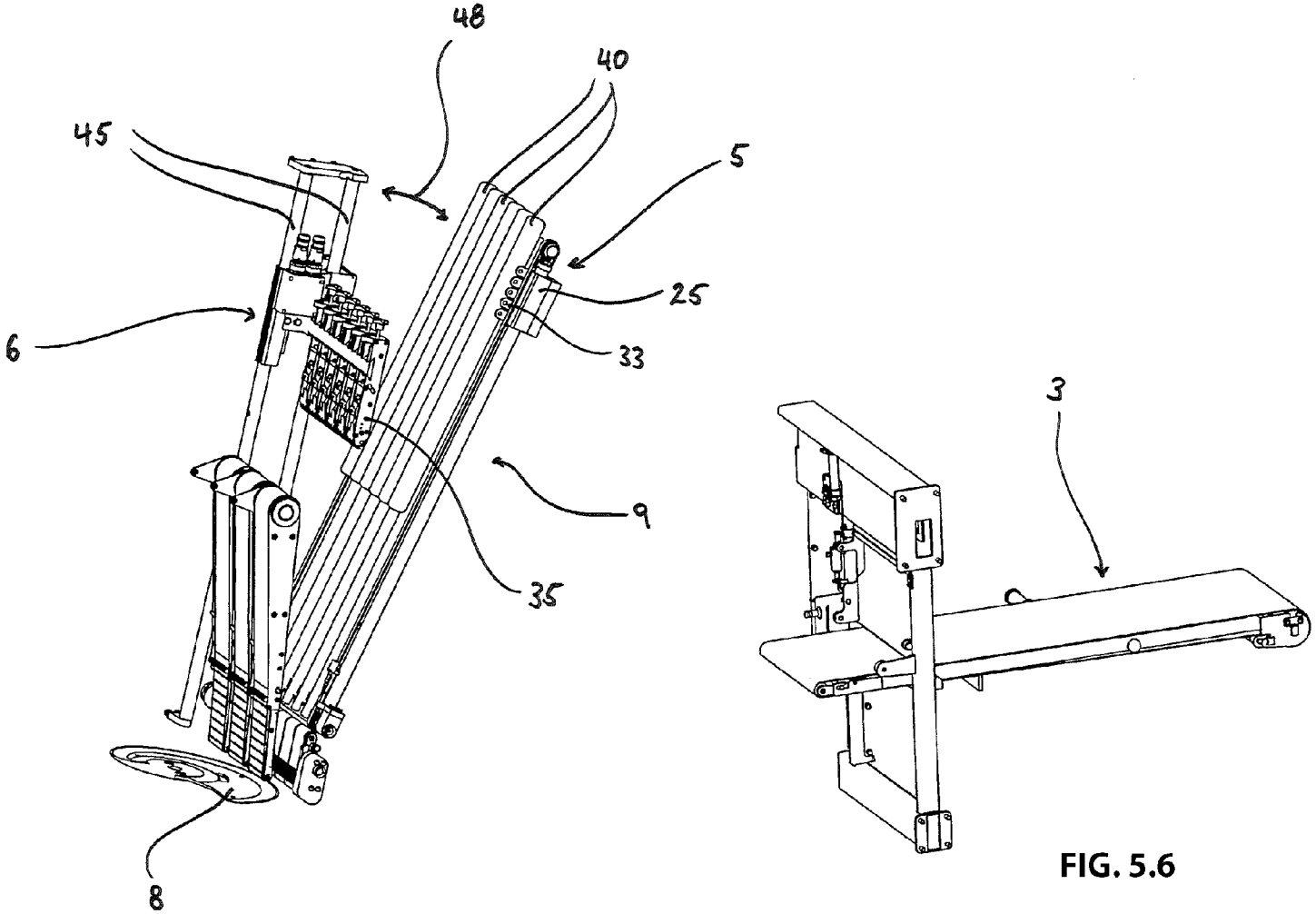
FIG. 5.6

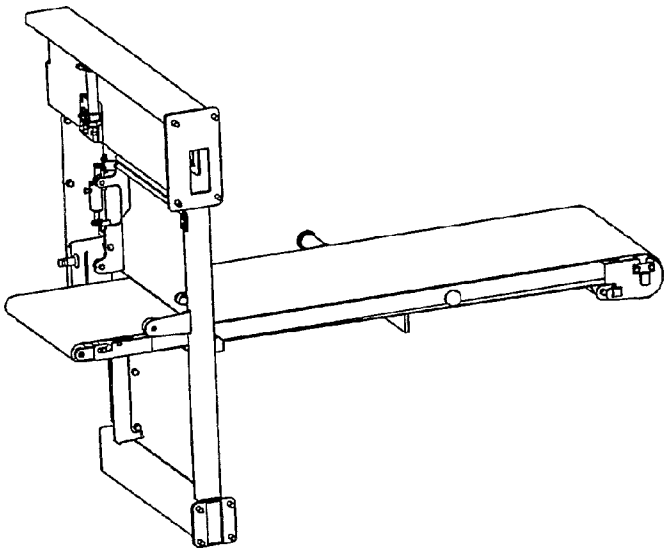
FIG. 5.7
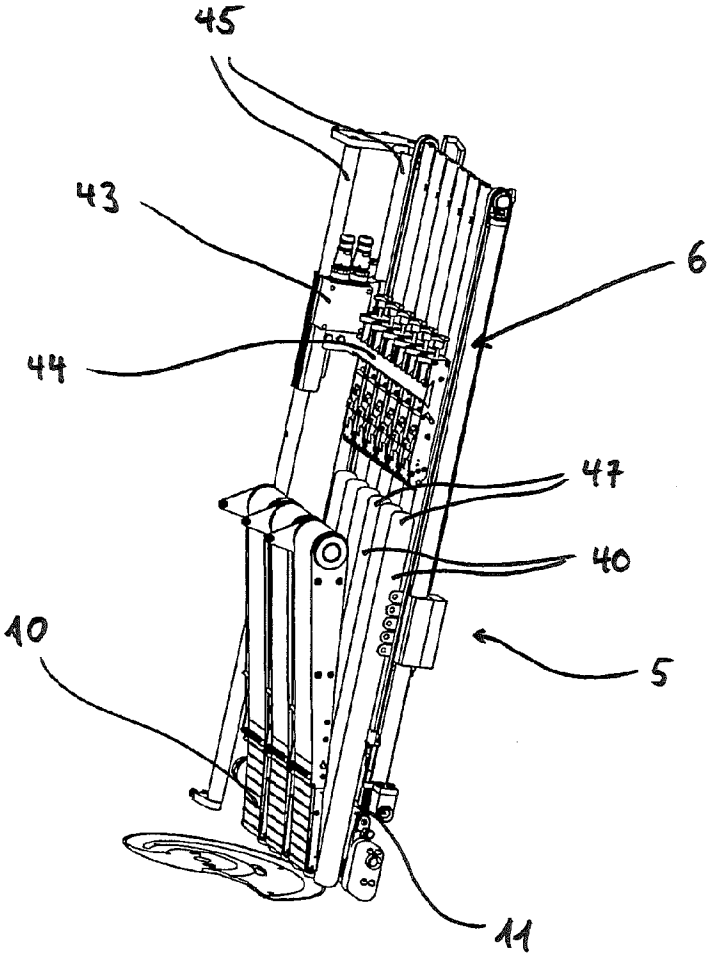

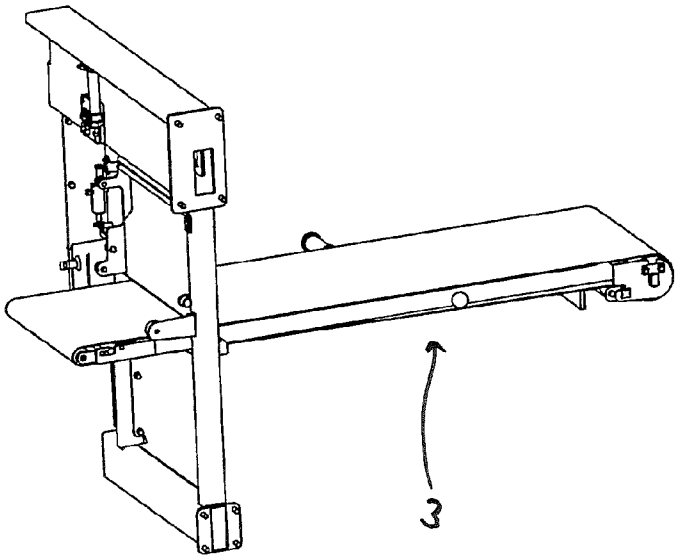
FIG. 5.8
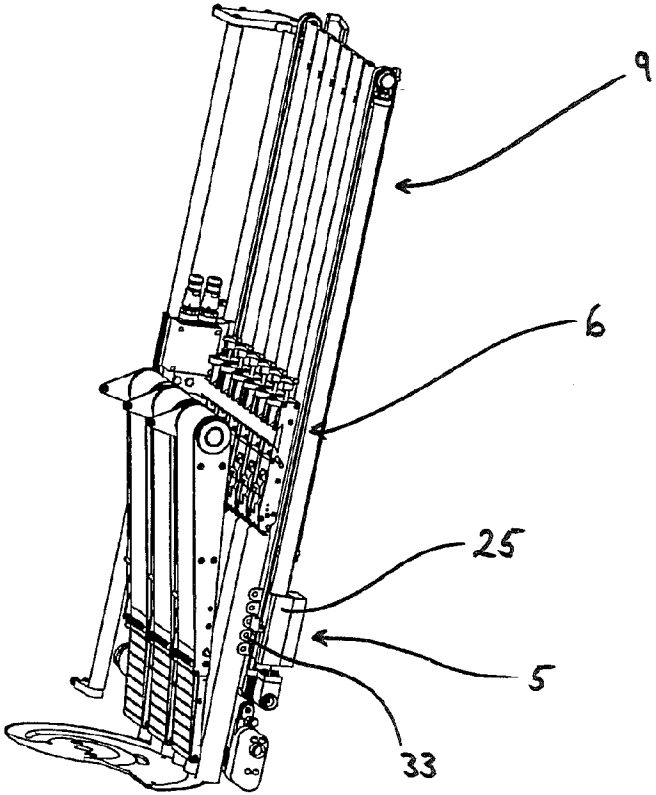

METHOD AND DEVICE FOR CUTTING A FOOD STRAND INTO SLICES

RELATED APPLICATIONS

This application claims priority from German application DE 10 2011 051 210.1 filed on Jun. 20, 2011, which is incorporated in its entirety by this reference.

FIELD OF THE INVENTION

The invention relates to a method for cutting at least one food strand into slices.

BACKGROUND OF THE INVENTION

A method and a device of similar types as recited supra are generally known in the art. Devices of this type are in particular designated as "high performance slicers" which are used for industrial production and processing of meat and sausage products and cheese products. Typically plural food strands are inserted in high performance slicers of this type parallel to one another, conveyed and sliced, wherein an accordingly large sized cut off blade sweeps over the cross sections of all food strands arranged adjacent to one another and thus cuts off a respective plurality of slices from the food strands with each revolution.

In a generally known method the food strands are placed by an operator in a parallel arrangement onto a conveying device configured as a conveyor belt and arranged to a large extent outside of machine housing. Then the food strands are simultaneously conveyed onto the feeding device by starting the conveyor belt, wherein the feeding device includes a number of narrow feeding belts with V-shaped cross sections, wherein the number of feeding belts corresponds to the number of simultaneously handled food strands. After a complete transfer of the food strands onto the feeding belts of the feed device the feed device is transferable through a pivot movement by e.g. 75° into the actual feed position. Previously the cutting process of the preceding plurality of food strands was completed and the support devices engaging the respective rear ends of the food strands have respectively released the residual pieces remaining at the support devices and have been moved from the end position proximal to the blade into the start position remote from the blade in order to grip and support the residual components at their ends after arrival of the next food strands at the feed position. This gripping process, however, is only initiated when the food strands due to being transferred into the "slanted position" according to the feed position in their respective front ends are placed in alignment with one another which is provided in that lower traction belts which support the feeding during the cutting process in a portion close to the blade were transferred into a locking position that is rotated by 90° and which locks the feed cross section for the food strands. The lower traction belts are thus used as a stop for the food strands that are produced with identical lengths so that due to the identity of lengths also the rear ends are approximately aligned with one another and can thus be made to interact with the support elements for all food strands which support elements are coupled to form a support unit.

A cutting device with a support unit of this type can be derived from DE 195 18 583 A1. The document shows a so called clamping plier support which is configured to grip a plurality of food strands arranged adjacent to one another from their back side and to subsequently feed them in a controlled manner to the blade of the cutting device. According to the description provided supra the clamping plier support engages the food strands as soon as they are in their feed positions, thus when they are arranged inclined relative to a horizontal axis. While the slanted food strands are fed towards the blade, the food strands can be supported through support devices, wherein in particular both lateral surfaces and a top side of a respective food strand are fixable while the respective bottom side contacts the respective feeding belt.

Another device which uses the principle of pivoting a plurality of food strands relative to horizontal is shown in EP 2 239 108 A2. Thus, the particular food strands are pivoted relative to horizontal through a separate device and are subsequently pushed or pulled from the pivoted position onto a feeding belt that is permanently slanted. During transfer of the food strands from the horizontal position into the "slanted position" the particular food strands are separated from one another through rigid divider walls and are thus blocked against lateral deviation or kinking.

It is disadvantageous for the known embodiment that in spite of an alignment of the food strands at their front ends an exactly aligned orientation at their back sides, this means rear ends, is not always successful. The reason is that the food strands while being produced by nature have a particular length tolerance which manifests itself through steps or shoulders at a back side of the food strands arranged parallel adjacent to one another. This in turn has the effect for support devices with hook shaped grippers which embed themselves into the material of the food strands that for safety reasons an engagement has to be adjusted further remote from the end of the food strand in order to positively prevent an engagement that is too close to the food strand end and thus a reduction of the maximum support force. Due to the arrangement of the plurality of the support elements in blocks an individual adjustment of the gripper hook distance from the respective food strand and is not possible. An unnecessarily large "safety distance" from the respective food strand end, however, during cutting operations causes a residual piece length that is unnecessarily large and thus causes economic disadvantages.

BRIEF SUMMARY OF THE INVENTION

Thus it is the object of the invention to provide a method and a device for cutting at least one food strand into slices which minimizes the size of the residual pieces remaining after the end of the cutting process and which increase process safety during cutting operation, which means in particular prevents the support device from tearing out of the end portion of the respective food strand. The method includes the steps:

a) inserting the food strand into a conveying device, wherein the food strand is placed into an inserted position;

b) conveying the food strand by the conveying device to a feed device, wherein the food strand is moved into a transfer position;

c) feeding the food strand through the feed device into a feed position in which the food strand is more inclined relative to horizontal than in the transfer position;

d) gripping and supporting the food strand at a rear end through a support device; and e) moving the food strand towards a cutting device;

f) cutting the food strand into successive slices through the cutting device.

Furthermore the invention relates to a device for cutting at least one food strand into slices, the device including:

a) a conveying device into which at least one food strand is insertable into an inserted position from which the food strand is conveyable.

b) a feed device to which the food strand is conveyable through the conveying device, wherein the food strand is then in a transfer position, wherein the food strand is transferable through the feed device into a feed position in which the food strand is more inclined relative to horizontal than in the transfer position and wherein the food strand is subsequently feedable in its longitudinal direction;

c) a support device through which the food strand is gripable and supportable at a rear end;

d) a cutting device through which the food strand is cut able into successive slices in a feed movement.

Based on a method recited supra the object is achieved in that the food strand at least during transfer from the transfer position into the feed position is fixated through at least one fixation element of a fixation device at least at one of its longitudinal sides, preferably at least at one of its free longitudinal sides, wherein the at least one fixation element form locks and/or friction locks the food strand.

The fixation of the food strand according to the invention prevents that the food strand during transfer or after transfer into the more inclined feed position slides forward and therefore as required in the prior art would have to be aligned at its front side. The form locking or friction locking provided with the food strands through the at least one fixation element is thus capable to absorb and react the gravity forces typically imparted on the food strands due to their slanted positions which would cause undesirable sliding. Thus, the fixation device facilitates to support the food strand also during and after transfer into the more inclined feed position in this position which is further inclined relative to the feed device. Thus, the method according to the invention accordingly facilitates an orientation of the food strand before being transferred into the feed position or provides the option to maintain an orientation provided before transfer into the feed position also after the transfer.

The option of an orientation in particular of a plurality of the food strands at their respective rear ends when using support devices with gripper hooks facilitates implementing a minimum residual piece length since no safety buffers have to be provided for compensating various positions of various food strands oriented adjacent to one another. Thus, cutting operations can be provided in a more economical manner since the food losses caused by the residual pieces are reduced.

Furthermore, the aligned orientation of the rear ends of the food strands facilitates using so called vacuum grippers as support devices since differently from gripper hooks adjusting a "safety reserve" with respect to the coupling location is not possible, at least when the vacuum gripper is also assembled from suction heads connected to form a block and moveable in feed direction through a common feed drive which under economic aspects is required compared to an individual movement and control of each suction head.

According to a preferred embodiment of the method according to the invention the food strand is respectively contacted at two opposite longitudinal sides respectively by a fixation element of the fixation device, preferably in that through two opposite clamping jaws of the fixation device a clamping force is imparted on an outer jacket of the food strand. Clamping jaws configured as fixation elements cause friction locking with the food strands. Safety during fixation is increased by such method compared to an unilateral engagement of the fixation force.

An embodiment of the invention furthermore provides that the food strand is fixated in a third of its length that is oriented towards its rear end while the food strand is transferred from the transfer position into the feed position.

When at least one fixation element of the fixation device is moved through a fixation drive in longitudinal direction of the food strand while it fixates the food strand, the fixation device also facilitates introducing longitudinal forces into the food strand, wherein the longitudinal forces can be used for example for the purposes of feeding. Thus, the fixation device provides another means for providing safe and gentle feeding of the food strand. Thus, it is appreciated that food strands have a length of 1 m or more which leads in particular for a soft consistency (meat sausage, meat loaf, spreading sausage, etc.) to problems for a punctiform force introduction and a sliding movement.

An embodiment of the method according to the invention in this respect provides that the food strand is fixated by the fixation device and is actively fed, preferably pulled while it is moved from the insertion position into the transfer position and/or while it is moved from the feed position in a direction towards the cutting device. The fixation device can thus preferably be used as a feed device during two phases of the process according to the invention.

It is appreciated that the fixation device for this purpose has to include suitable drive devices that can move the at least fixation element relative to the feed device.

In order to increase the performance of the cutting method it is proposed according to the invention that the food strand is moved through the feed device into an idle position and stopped there, wherein the idle position is between the transfer position and the feed position. This way during the cutting operation a new batch of food strands can be moved very close to the movement plane of the support device, thus to the location from which the actual feed movement occurs later on, so that the time loss after completing the cutting process of the preceding batch of food strands is accordingly shorter than for the known methods. In this context it is proposed for obtaining parallel timing of the processes that is as large as possible in order to increase performance, that the food strand:

a) in a first phase of a feed movement in which the food strand is moved towards the cutting device starting with the feed position the food strand is only fixated by the fixation device and/or;

b) in a second phase of the feed movement the food strand is fixated by the fixation device and supported by the support device and/or c) in a third phase of the feed movement the food strand is only supported by the support device.

The method step described under a) has the advantage that cutting up a new food strand can already be commenced at a point in time when the support device after finishing the cutting process of the preceding food strand has been moved back into its starting position. Thus, it is not required to bring the support device into engagement or contact with the rear end of the new food strand which according to the invention can also be provided for a feed movement that is already in process, this means during cutting operation. This way another performance increase can be implemented.

The method according to b) provides particularly large process safety since the food strand in this phase which typically represents a center phase of the cutting process can be fixated by the fixation device and can also be supported by the support device. In the center phase of the cutting process a "double support" or "double fixation" does not impair cutting performance since subsequently sufficient time will be required in order to provide a new batch of food strands for the cutting process which in turn requires the fixation device.

When using the method according to c) the advantage can be obtained that the fixation device in particular the feed device to which the fixation device is coupled is not required for safe processing anymore during cutting operations for a remaining strand length of less than 200 to 300 mm. Rather support for the food strand in this case is typically provided through a respective lower and upper traction belt in combination with the support device. Therefore it is helpful for performance increase that the feed device and the fixation device connected therewith are already moved back into the transfer position in order to be able to start with the next loading process.

Based on a device of this type as recited supra the object is achieved through a fixation device including at least one fixation element through which the food strand at least during transfer from the transfer position into the feed position at least at one of its longitudinal sides, preferably at least at lone of its free longitudinal sides is fixated, wherein the at least fixation element provides form locking and/or friction locking engagement with the food strand.

Through a device of this type the method according to the invention can be performed in a particularly simple manner. Thus, the fixation device facilitates an aligned orientation of a plurality of food strands at their rear ends viewed in feed direction without an orientation of this type being put at risk by transferring the feed device into the more inclined feed position. A locking device for obtaining an alignment at the front ends can thus be completely omitted which in turn reduces the complexity of the device since an adjustment of the lower traction belt into a locking position is not required anymore. The substantial advantages resulting from an alignment of the rear ends has already been described supra.

An embodiment of the device according to the invention provides that the feed device together with the fixation device is pivotable relative to a machine frame about an axis which extends perpendicular to the feed direction and also perpendicular to a movement direction of the food strand for its transfer from the inserted position into the transfer position.

In a preferred embodiment the fixation elements are configured as clamping jaws which can be pressed through a clamping drive from opposite sides against free longitudinal sides of the food strand and which are remove able again from the longitudinal sides. Preferably a contact surface of at least one clamping jaw has a surface texture increasing friction and/or causing (micro form locking). For a food strand resting on a support rail or a conveyor belt the lower longitudinal side on which the food strand is supported is not to be considered as a free longitudinal side but only the two opposite vertical longitudinal sides and the horizontal upper longitudinal side are to the considered as "free longitudinal sides". In food strands whose cross section is not even remotely polygonal but circular or oval accordingly cambered surface sections of the outer jacket of the food strand are defined as "longitudinal sides" according to the invention.

According to a preferred embodiment of the present invention the fixation elements are arranged at a fixation slide which is moveable through a slide drive, preferably through at least one synchronous belt in feed direction of the food strand relative to the feed device and wherein the fixation slide is advantageously connected with the feed device through a linear guide.

When a respective plurality of food strands is arrangeable with their respective longitudinal direction parallel adjacent to one another on the insertion device and also on the feed device, wherein the fixation elements for all food strands are actuatable through a single drive, a particularly effective and efficient fixation process can be obtained.

The device complexity can be kept low in this context when the clamping jaws are divided into a first group and a second group, wherein the clamping jaws of a respective group contact the food strands from the same longitudinal side and wherein the clamping jaws of the first group are arranged at a first transversal movement slide and the clamping jaws of a second ground are arranged at a second transversal movement slide. Furthermore the transversal movement slides can be moveable relative to the fixation slide perpendicular to the longitudinal axis of the food strands and respectively in opposite directions.

In order to facilitate an aligned orientation of the food strands a stop element which is arranged at the feed device preferably configured as conveyor belt, in particular a stop bar can be used through which the food strands are alignable at their rear ends so that they are oriented in flush alignment.

Eventually it is also provided according to the invention that the feed device includes a support element for each food strand, preferably a support rail along which the respective food strand during feeding from the insertion device onto the feed device and during the feed movement is supportable preferably in a sliding manner. Omitting an actively moved surface of the support elements or support rails is provided by using the actively moveable fixation elements which act as feed devices which are preferably used in a pulling manner when they are moved relative to the feed device, that means relative to the support elements.

BRIEF DESCRIPTION OF THE DRAWINGS

The method according to the invention is subsequently described in more detail with reference to a device for cutting a food strand into slices which is illustrated in the drawing figure, wherein:

FIG. 5.1-5.8 illustrate a sequence of eight snapshots during a complete cutting cycle.

DETAILED DESCRIPTION OF THE INVENTION

Figure 1:
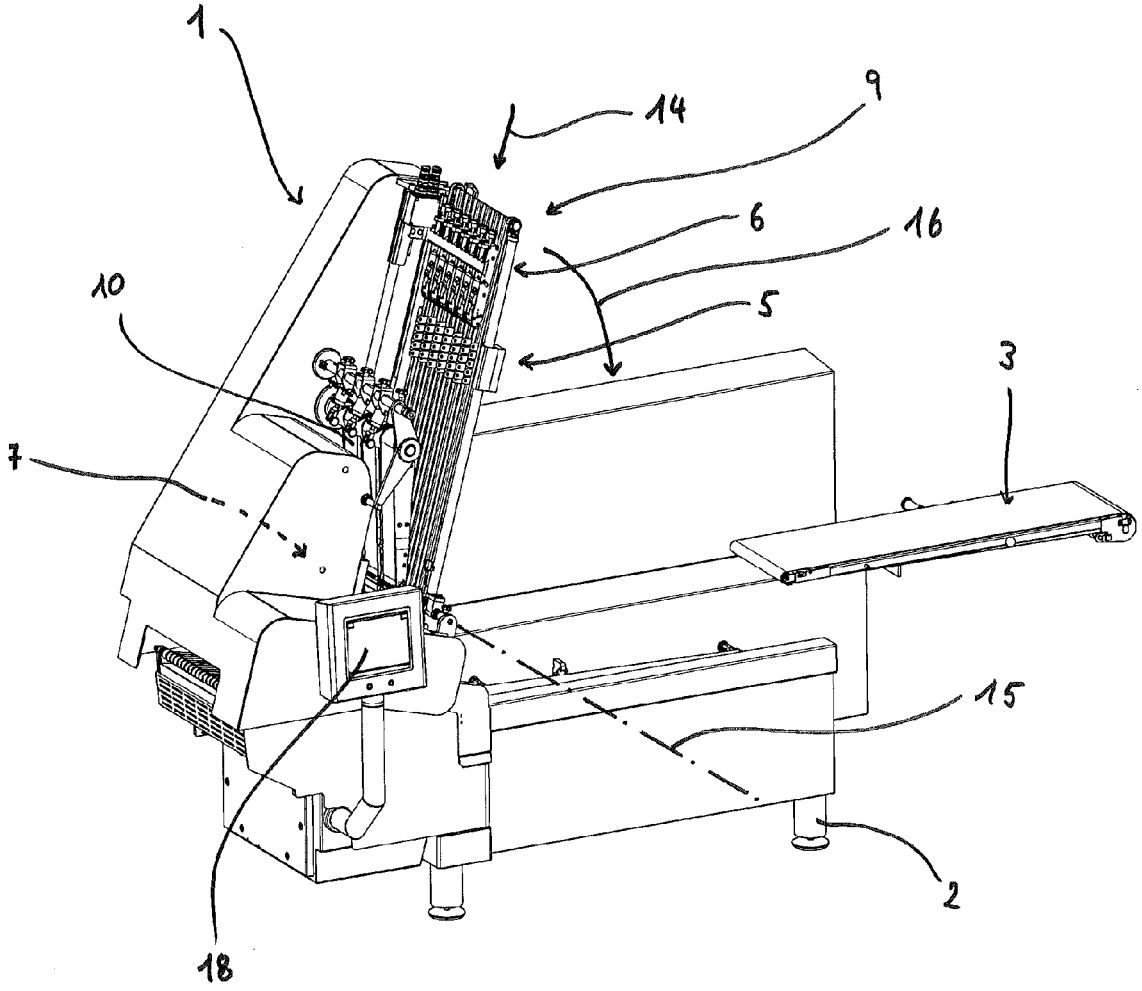
FIG. 1 illustrates a device for simultaneously cutting of six food strands into slices without a machine housing.

A device 1 illustrated in FIG. 1 for simultaneously cutting of six food strands 40 into slices includes a machine frame 2 placed on a floor, a conveying device 3 configured as a conveying belt, a feed device 4, a fixation device 5, a support device 6 and a cutting device 7 which is not visible in FIG. 1 due to a cover, wherein the helical cutting blade 8 of the cutting device 7, however, is illustrated in FIGS. 5.1-5.8.

Figure 2:
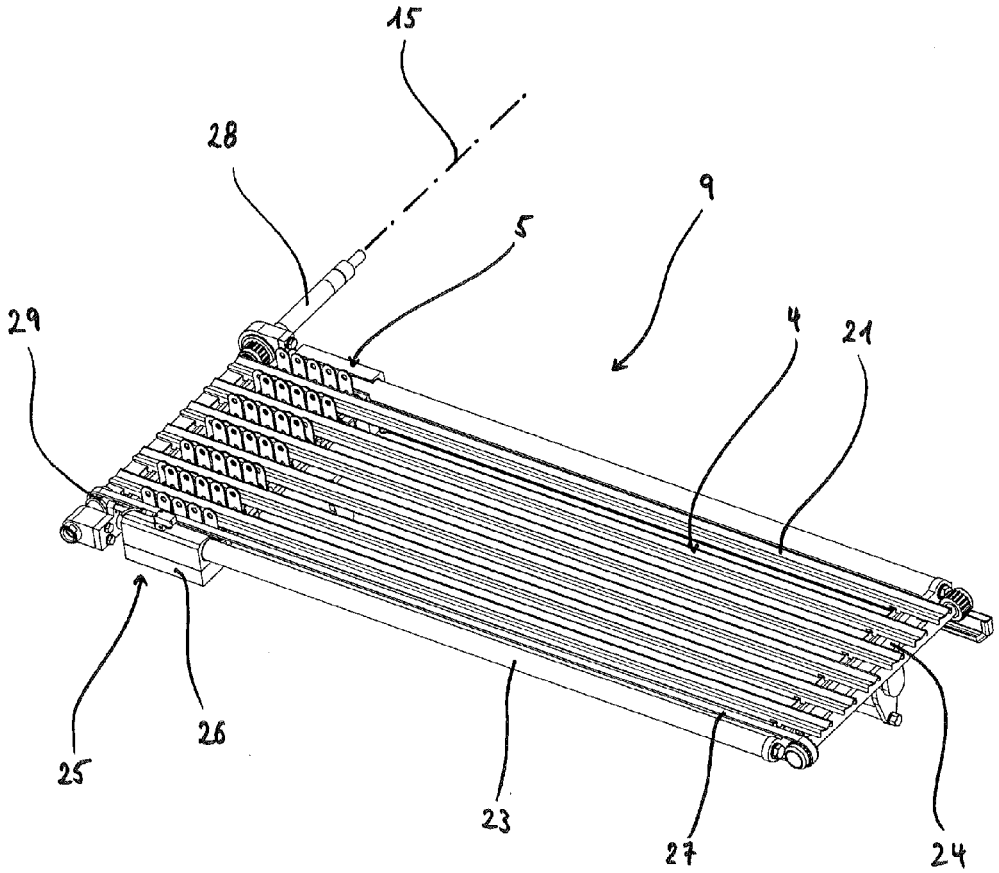
FIG. 2 illustrates a loading pivot including a feed device and a fixation device.

The feed device 4 and the fixation device 5 together form a loading pivot 9 which is illustrated separately in FIG. 2. Additionally the device 1 includes three upper traction belts 10 extending parallel to one another within the same level (a traction belt 10 for two respective adjacent food strands 40) and six lower traction belts 11 extending parallel to one another within the same plane, wherein the food strands 40 not illustrated in FIG. 1 are arranged during feeding towards the cutting device 7 respectively between two traction belts 10, 11 which impact with respective pressure the opposite free upper and lower longitudinal sides of the food strands 40 thus causing a safe support of the food strands on a path to the cutting device 7 and in particular also in the last feed section before the cutting device 7. For reasons of clarity FIG. 1 does not illustrate a machine housing which encapsulates the machine for accident prevention in an inaccessible manner, in particular the portion of the device 1 in which the loading pivot 9 and the cutting device 7 are arranged. In FIGS. 5.1-5.8 only a portal element 12 of the machine housing is illustrated, wherein the portal element is configured with a pivotal closure cap 13 which in open position releases a feed opening or closes the feed opening in closed position and thus prevents an operator from reaching in.

FIG. 1 illustrates the loading pivot 9 in a feed position in which it is arranged tilted by an angle of 75° relative to horizontal. In the feed position the food strands 40 arranged on the feed device 4 are supported and/or fixated by the support device 6 and moved by the fixation device 5 in feed direction (arrow 14) towards the cutting device 7. The fixation through the fixation device 5 is facilitated in the illustrated embodiment through a friction locking between the fixation device 5 and the food strands 40. The loading pivot 9 is pivotably supported about an axis 15 so that it is pivotable starting from the feed position illustrated in FIG. 1 in a direction of the arrow 16 into a transfer position in which it is illustrated in FIGS. 5.1-5.5.

Through additional handling devices (scale, storage table with intermediary storage etc.) not illustrated in the figures the slices generated from the food strands 40 are arranged e.g. in stacks and subsequently packaged into self service packs made from plastic foil. FIG. 1 furthermore illustrates an operator interface 18 configured as a touch screen through which different parameters are adjustable for cutting operations of the device 1. Eventually the device 1 includes a conveyor belt that is not depicted through which residual pieces disengaged from the support device 6 can be captured after completing a cutting cycle and can be fed into a container 20.

FIG. 2 illustrates an enlarged representation of the loading pivot 9 which includes the feed device 4 and the fixation device 5. The feed device 4 in turn is configured from six support rails 21 oriented parallel to one another, wherein the support rails are attached at a common pivot frame 22 which among other things is assembled from two longitudinal side support rods 23 and two face side transversal rods 24. The pivot frame 22 is overall pivotably supported in the machine frame (c.f. FIG. 1) with the support rail 21 and the entire fixation device about an axis that is not illustrated. The drive for the pivot movement of the loading pivot 9 is provided through a pivot lever permanently coupled with a pivotable drive shaft, wherein at an end of the pivot lever a rotatably supported roller is arranged which interacts with a slotted link drive at a bottom side of the pivot frame 22 and thus transposes the pivoting movement of the lever into a pivoting movement of the loading pivot 9.

Figure 3:
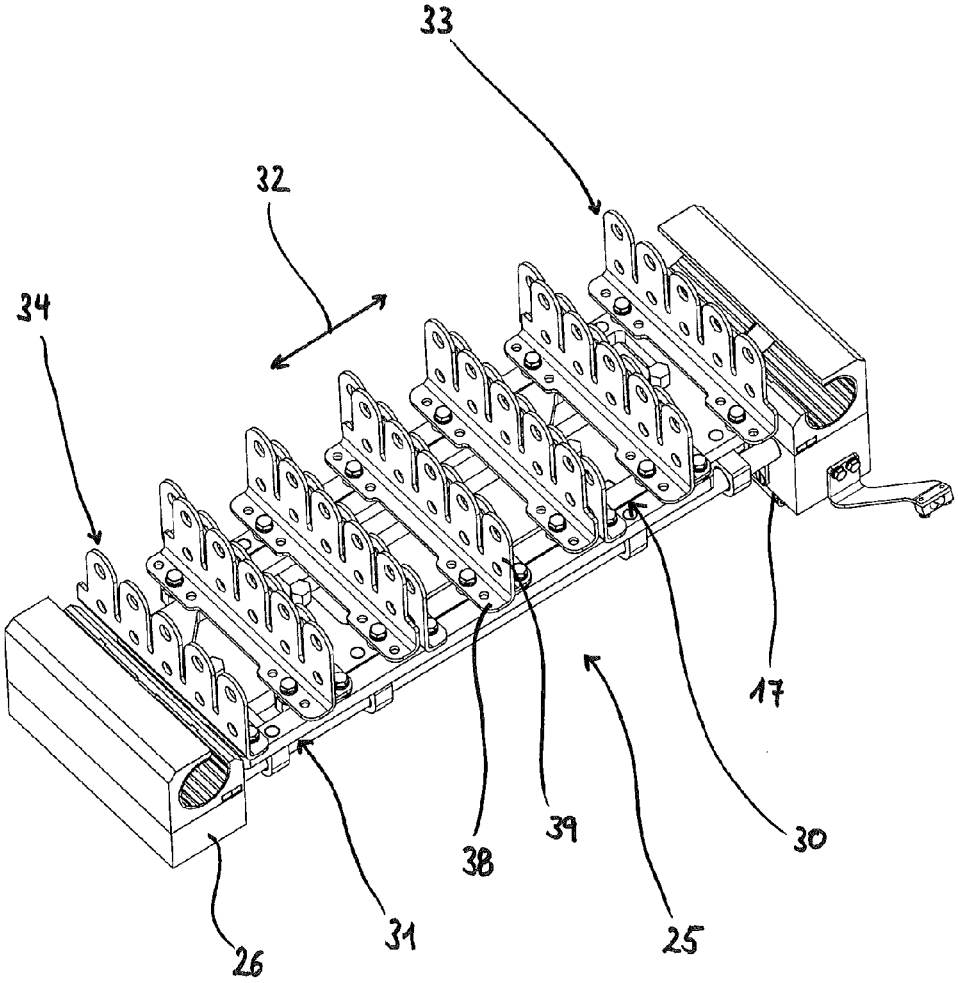
FIG. 3 illustrates a fixation slide of the fixation device including two transversal movement slides.

The fixation device 5 includes a fixation slide 25 that is illustrated in detail in FIG. 3, wherein the fixation slide with its support elements 26 arranged at opposite ends is moveable supported on the support rods 23 of the pivot frame 22. Driving the fixation slide 25 is provided through two synchronization belts 27 which are respectively arranged between one of the support rods 22 and the adjacent outer support rail 21. Each synchronization belt 27 is connected with the fixation slide 25 in a portion of an upper main element of the synchronization belt in a force transferring manner in a connection section arranged in the respective support element 26. Between the lower main element and the support element 26 a touch free, this means friction free, relative movement is feasible.

Through a shaft 28 which extend coaxial to the axis 15 two synchronization discs 29 are driven which are in engagement with the synchronization belts 27. This way the fixation slide 25 coupled with the synchronization belts 27 is moveable over the entire free length of the support rods 23 back and forth at will.

The configuration of the fixation slide 25 can be derived particularly well from the illustration in FIG. 3. At the fixation slide 25 two transversal movement slides 30 and 31 are moveably supported in the direction of a double arrow 32. The respective linear supports are not illustrated in FIG. 3. At the transversal movement slide 30 six clamping jaws are attached which operate as fixation elements 33. In the same manner six fixation elements 34 also operating as a clamping jaw are attached at the transversal movement slide 31. When one transversal movement slide 30 is moved in one direction through a special pneumatic cylinder 17 arranged in one of the support elements 26 and the other transversal movement slide 31 is moved into the other direction through the same pneumatic cylinder 17, the fixation elements 34 attached in an alternating manner in two groups on the respective transversal movement slides 30, 31 move in pairs either towards one another or away from one another. When they move towards one another the food strands 40 which are arranged respectively between two adjacent fixation elements 33 on the support rails 21 arranged at this location are either clamped or released. The support rails 21 are not illustrated in FIG. 3 for reasons of clarity but are illustrated in FIG. 2 with respect to their extension respectively between two adjacent fixation elements 33, 34.

Figure 4:
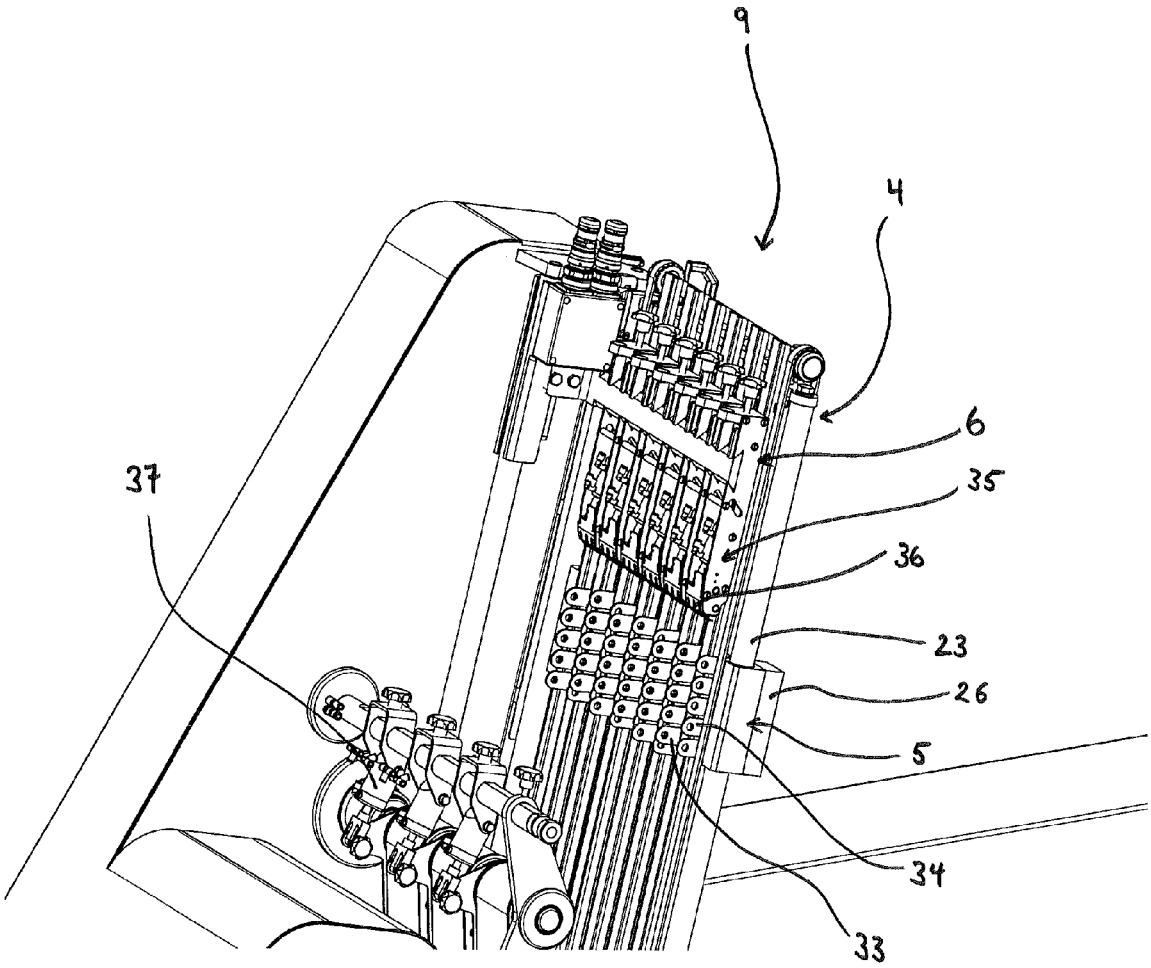
FIG. 4 illustrates a partial view of the loading pivot with a fixation device and a support device.

From FIG. 1 and in particular from the enlarged illustration in FIG. 4 it is apparent that the support device 6 is assembled from six support elements 35 arranged parallel to one another and one respective support rail 21 of the feed device 4, this means also respectively two fixation elements 33, 34 associated with the fixation device 5. Each support element 35 is configured in the form of a known gripping device with gripping hooks 36 penetrating in pairs from opposite sides into the respective food strand 40. While the gripper hooks 36 of the support elements 35 penetrate each food strand 40 respectively from an associated rear end of each food strand 40 the fixation elements 33, 34 of the fixation device 5 engage the free longitudinal sides of the food strands 40 in a clamping manner, this means through generating a friction force. In order to generate particularly large clamping- or friction forces it is also possible to configure the fixation elements 33, 34 on their sides respectively oriented to the food strand 40 with micro form locking elements which at least slightly penetrate an outer envelope of the respective food strands 40 and therefore only cause an elastic deformation without leaving traces in the food product and also in the slices subsequently produced. In the illustrated embodiment each fixation element 33, 34 is assembled from a plurality of clamping fingers 39 coupled with one another through a respective common base arm 38.

FIG. 4 furthermore illustrates actuation cylinders 37 of the upper traction 10 belt which are used for pressing the upper traction belt 10 always with the required contact pressure against the upper longitudinal side of the respective food strand 40 in order to generate good traction during the feed movement.

Subsequently the sequence of a cutting method according to the invention is described in more detail with reference to FIGS. 5.1.-5.8.

In FIG. 5.1 six food strands 40 are arranged on the conveying device 3, wherein the food strands have a consistency of soft meat spread sausages which respectively have a length of approximately 1200 mm. The food strands 40 are respectively arranged in alignment with one another at their rear ends using a stop element 41 attached at a conveying band of the conveying device 3. The parallel alignment of the particular food strands 40 relative to one another can be facilitated by using an insertion device arranged above the conveyor belt of the conveying device 3. The closing cap 13 of the portal element 12 of the machine housing is closed so that an operator cannot unintentionally reach into the portion of the loading pivot 9. The loading pivot 9 is arranged in the transfer position in which it waits for a transfer of the food strands 40 through the conveying device 3.

In FIG. 5.1 the fixation slide 25 of the fixation device 5 is arranged in its left side end position in which it is still disposed from the preceding method step that is not illustrated.

At the left end of the device 1 the three upper traction bands 10, the spiral shaped cutting blade 8 (rotation direction according to arrow 42) of the cutting device 7 and the support elements 35 of the support device 6 are illustrated. The support elements 35 that are combined to form a coherent block are connected through a transversal beam 44 with a support slide 43 of the support device 6, wherein the support slide 43 is moveable in a linear manner along two support rods 45. The orientation of the support rods 45 is 75° relative to a horizontal plane. The orientations of the support rods 45 and thus of the support device 6 relative to the machine frame 2 is not variable. The support rods 45 and also the longitudinal axes of the food strands 40 during feeding are aligned parallel to a rotation axis of the cutting cavity 8, this means perpendicular to a blade plane.

Furthermore it is apparent from FIG. 5.1 that the support device 6 respectively supports six food strands 40 at their rear ends. These food strands 40 are already to a large extent cut into slices. Their residual length is approx. 300 mm and is continuously shortened. The feed movement is performed by the support device 6, the three upper traction belts 10 and the six lower traction belts 11 which are better visible in particular in FIG. 5.6.

In view of FIG. 5.2 it is apparent that compared to the illustration in FIG. 5.1 the closing cap 13 is open now and the conveyor belt of the conveying device 3 has already conveyed the food strands 40 to the front end of the conveying device 3 so that a transfer to the loading pivot 9 is to be performed shortly thereafter. In the mean time the fixation device 5 has moved from its left end position into its right end position. The cutting process of the food strands 40 supported by the cutting device 6 was continued in the mean time so that the remaining strand length has been shortened slightly.

FIG. 5.3 illustrates a situation in which the food strands 40 with a portion of their length are already arranged on the feed device 4, wherein the upper ends 46 of the food strands 40 already extend beyond the fixation slide 25 of the fixation device 6. In this position of the food strands 40 the fixation elements 33, 34 can become active and can respectively clamp a food strand 40 proximal to the front end 46 between one another. The cutting process of the food strands 40 of the previous batch continues in the meantime.

FIG. 5.4 illustrates a situation in which the food strands 40 are almost completely transferred into the loading pivot 9 arranged approximately in horizontal position (transfer position). The fixation slide 25 of the fixation device 6 has moved through activation of a non visible slide drive accordingly far in a direction towards its forward end position and has thus pulled the food strands 40 onto the support rails 21 of the feed device 4, wherein the conveyor belt of the conveying device 3 also using the bar shaped stop element 41 has slightly advanced the food strands at their rear ends 47. This prevents that the transfer of the food strands 40 from the conveying device 3 to the feed device 4 is only performed by a pressure imparted by the conveying device 3 since in this case there would be the risk that the food strands 40 due to their very soft consistency move out laterally which would defy correct positioning and would render correct cutting operations impossible thereafter. The length of the food strands still undergoing a cutting process has shortened further in the mean time.

Differently from the situation in FIG. 5.4 the fixation slide 25 of the fixation device 6 was moved in the mean side from the front end 46 further in a direction towards the upper end 47 of the food strands 40, wherein the fixation elements 33, 34 were disengaged before moving the fixation slide 25 and were subsequently moved towards one another again in the position of the fixation slide 25 illustrated in FIG. 5.5 in order to fixate the food strands 40 at the respective location in a clamping manner. The closure cap 13 is in its closed position again. The cutting process of the food strands 40 supported by the support device 6 is now completed.

In FIG. 5.6 the loading pivot 9 has left the transfer positions assumed in FIGS. 5.1-5.5 and has assumed an idle position instead in which it is arranged at an angle of approx. 60° relative to horizontal and thus encloses a differential angle 48 relative to the support rods 45 of the support device 6 of approximately 15°. In spite of the strong inclination of the loading pivots 9 the food strands 40 due to the activation of the fixation device 5 remain quasi suspended in their positions on the support rails. 21.

After completing the cutting process of the food strands 40 of the preceding batch the residual parts of the food strand are disengaged from the gripper hooks 36, wherein after the support elements 35 of the support device 6 are moved from its lower end position into the upper end position illustrated in FIG. 5.6. A collision with the food strands 40 disposed in the idle position therefore does not occur.

Without a collision with the totally pulled back block of the support elements 35 occurring, the loading pivot 9 is now pivoted further from the idle position by the differential angle 48 of 15° into the feed position. Subsequently the food strands 40 are moved downward towards the cutting blade 8 of the cutting device 7 by starting the slide drive, this means a respective movement of the fixation slide 25.

FIG. 5.7 illustrates in this context a situation in which the food strands 40 with their front sections are arranged between the upper traction belts 10 and the lower traction belts 11 and are furthermore only fixated by the fixation device 5. The cutting process is already started in this situation without waiting that the support device 6 moves downward towards the rear ends 47 of the food strands 40 and grips and supports the food strands 40 at this location. Starting the cutting process early saves time and thus increases the performance of the device 1 without the lack of a rear support of the food strands 40 in the initial phase of the cutting process having a negative effect.

After engagement of the support device 6 at the rear ends 47 of the food strands 40 the "regular" cutting operation commences in which the support device 6 and also the fixation device 5 are active.

As soon as the fixation slide 25 of the fixation device 5 has reached the lower end position illustrated in FIG. 5.8 and thus the fixation elements 33, 34 would have to be disengaged from the respective food strands 40 anyhow, the loading pivot 9 can be moved in empty condition back from its feed position into its transfer position illustrated in FIG. 5.1. The food strands 40 that are undergoing a cutting process are sufficiently supported from this point in time by the traction belts 10, 11 and are sufficiently supported at their rear ends by the support device 6.

After moving the loading pivot 9 into the transfer position and feeding the conveying band 3 with new food strands 40 the initial situation illustrated in FIG. 5.1 is reached again and the cycle can start again.

REFERENCE NUMERALS AND DESIGNATIONS

1 device
2 machine frame
3 conveying device
4 feed device
5 fixation device
6 support device
7 cutting device
8 cutting blade
9 loading pivot
10 upper traction belt
11 lower traction belt
12 portal element
13 closure cap
14 arrow
15 axis
16 arrow
17 pneumatic cylinder
18 operator interface
21 support rail
22 pivot frame
23 support rod
24 transversal beam
25 fixation slide
26 support element
27 synchronous belt
28 shaft
29 synchronous disc
30 transversal movement slide
31 transversal movement slide
32 double arrow
33 fixation element
34 fixation element
35 support element
36 gripper hook
37 actuation cylinder
38 base arm
39 clamping finger
40 food strands
41 stop element
42 arrow
43 support slide
44 transversal beam
45 support rod
46 front end
47 rear end
48 differential angle

What is claimed is:

1. A method for cutting a plurality of food strands into slices, comprising the steps:

inserting food strands into an inserted position in a conveying device;

conveying the food strands from the inserted position through the conveying device into a transfer position in a feed device;

aligning rear ends of the food strands oriented away from a cutting device before transferring the food strands from the transfer position into a feed position;

transferring the food strands through the feed device from the transfer position into the feed position where the food strands are more inclined relative to horizontal than in the transfer position;

gripping and supporting the rear ends of the food strands through a support device;

feeding the food strands towards a cutting device;

cutting the food strands into successive slices through the cutting device; and fixating the food strands at least during transfer from the transfer position into the feed position at least at one of their free longitudinal sides through at least one fixation element of a fixation device, wherein the at least one fixation element provides a form locking or friction locking engagement with a respective food strand.

2. The method according to claim 1, wherein the food strands are respectively contacted at two opposite longitudinal sides by the at least one fixation element of the fixation device so that a clamping force is imparted upon an outer jacket of a respective food strand through two clamping jaws of the fixation device which are arranged opposite to one another.

3. The method according to claim 1, wherein the food strands are fixated in a third of their length oriented towards the rear ends of the food strands while the food strands are transferred from the transfer position into the feed position.

4. The method according to claim 1, wherein at least one fixation element of the fixation device is moved in longitudinal direction of the food strands while the fixation element fixates the food strands.

5. The method according to claim 1, wherein the food strands are fixated by the fixation device and actively fed through pulling from the conveying device to the feed device while being moved from the inserted position into the transfer position or while being moved from the feed position in a direction towards the cutting device.

6. The method according to claim 1, wherein the food strands are transferred through the feed device into an idle position and stopped in the idle position which is arranged between the transfer position and the feed position.

7. The method according to claim 1, wherein the food strands are only fixated by the fixation device in a first phase of the feed movement in which the food strands are moved from the feed position towards the cutting device or;

wherein the food strands are fixated by the fixation device and supported by the support device in a second phase of the feed movement or;

wherein the food strands are only supported by the support device in a third phase of the feed movement.

8. The method according to claim 1, wherein the feed device is moved back from the feed position into the transfer position while a remaining portion of the food strands is moved forward and cut into slices and supported by the support device during the cutting.

* * * * *